US010274246B2

(12) United States Patent
Kagawa et al.

(10) Patent No.: US 10,274,246 B2
(45) Date of Patent: Apr. 30, 2019

(54) OUTDOOR UNIT OF AIR CONDITIONING DEVICE

(75) Inventors: Mikio Kagawa, Sakai (JP); Shigeki Kamitani, Sakai (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 337 days.

(21) Appl. No.: 14/116,094

(22) PCT Filed: May 16, 2012

(86) PCT No.: PCT/JP2012/062456
§ 371 (c)(1),
(2), (4) Date: Nov. 6, 2013

(87) PCT Pub. No.: WO2012/161038
PCT Pub. Date: Nov. 29, 2012

(65) Prior Publication Data

US 2014/0131019 A1 May 15, 2014

(30) Foreign Application Priority Data

May 20, 2011 (JP) ..... 2011-113959

(51) Int. Cl.
*F25D 23/00* (2006.01)
*F24F 1/14* (2011.01)
(Continued)

(52) U.S. Cl.
CPC ..... *F25D 23/00* (2013.01); *F24F 1/14* (2013.01); *F24F 1/16* (2013.01); *F24F 1/22* (2013.01);
(Continued)

(58) Field of Classification Search
CPC ..... F25D 17/02; F25D 17/06; F25D 23/00; F24F 1/14; F24F 1/16; F24F 1/18; F24F 1/22; F24F 1/48; F24F 1/50; F24F 1/24
See application file for complete search history.

(56) References Cited

U.S. PATENT DOCUMENTS 5,117,656 A * 6/1992 Keck ..... F04D 29/601 417/360
8,191,381 B2 * 6/2012 Kim ..... F04D 29/263 62/428
(Continued)

FOREIGN PATENT DOCUMENTS

EP 1837608 A1 9/2007
JP 47-22782 7/1972
(Continued)

OTHER PUBLICATIONS

JP2010127530A English Translation of Description.*
(Continued)

*Primary Examiner* — Todd E Manahan
*Assistant Examiner* — Marcos O Diaz
(74) *Attorney, Agent, or Firm* — Birch, Stewart, Kolasch & Birch, LLP

(57) ABSTRACT

An outdoor unit of an air conditioning device includes an outdoor unit main body having a square planar shape, a heat exchanger provided along a side surface of this outdoor unit main body, and a fan provided in an upper part of the outdoor unit main body, the fan for blowing out air in the outdoor unit main body upward. An opening portion capable of providing communication between an interior and an exterior of the outdoor unit main body is formed between a one side end portion and an other side end portion of the heat exchanger adjacent to each other, and in at least one of the side end portions positioned in a peripheral edge of the
(Continued)

opening portion, a cover member for covering a heat transfer tube protruding from the side end portion is provided.

21 Claims, 11 Drawing Sheets

(51) Int. Cl.
*F24F 1/22* (2011.01)
*F24F 1/50* (2011.01)
*F28F 9/00* (2006.01)
*F24F 1/16* (2011.01)

(52) U.S. Cl.
CPC ..... *F24F 1/50* (2013.01); *F28F 9/002* (2013.01); *F28F 2265/02* (2013.01)

(56) References Cited

U.S. PATENT DOCUMENTS

2002/0134099 A1* 9/2002 Mochizuki ..... F24F 1/18 62/285
2005/0145705 A1* 7/2005 Shah ..... F24F 11/0086 236/51
2005/0279115 A1* 12/2005 Lee ..... F24F 1/0007 62/314
2007/0163295 A1* 7/2007 Martin, Sr. ..... F24F 1/08 62/507
2009/0084131 A1 4/2009 Reifel et al.
2010/0269518 A1* 10/2010 Burns ..... F24F 1/22 62/77
2011/0073277 A1* 3/2011 Karl ..... F24F 13/30 165/67
2011/0174013 A1* 7/2011 Moraes ..... F24F 1/16 62/498
2011/0312264 A1* 12/2011 Kim ..... F24F 1/38 454/338
2012/0085113 A1* 4/2012 Tran ..... F24F 1/20 62/186
2012/0312046 A1* 12/2012 Kim ..... F24F 1/24 62/259.2

FOREIGN PATENT DOCUMENTS

JP 53-126065 10/1978
JP 54-167460 11/1979
JP 58-44303 Y2 10/1983
JP 60-18767 Y2 6/1985
JP 60-83868 U 6/1985
JP 6083868 U * 6/1985
JP 5-90224 U 12/1993
JP 2004-125264 A 4/2004
JP 2005-134087 A 5/2005
JP 2009-79871 A 4/2009
JP 2010127530 A * 6/2010
KR 10-2004-0108252 A 12/2004
KR 10-2010-00884402 A 7/2010
WO WO 2004/083734 A2 9/2004
WO WO 2011/055598 A1 5/2011

OTHER PUBLICATIONS

English Description Translation of JP6083868U (Year: 1985).*
International Search Report for PCT/JP2012/062456 dated Aug. 14, 2012.

* cited by examiner

OUTDOOR UNIT OF AIR CONDITIONING DEVICE

TECHNICAL FIELD

The present invention relates to an outdoor unit of an air conditioning device.

BACKGROUND ART

As a conventional air conditioning device, for example as disclosed in Patent Literature 1 described below, there is a known air conditioning device provided with an outdoor unit in which a heat exchanger is provided along four side surfaces of an outdoor unit main body having a square planar shape, and by actuating a fan provided in an upper part of the outdoor unit main body, the air suctioned from the four side surfaces of the outdoor unit main body is blown out from the upper part of the outdoor unit main body.

In the outdoor unit described in Patent Literature 1, an opening portion is formed between a one side end portion of the heat exchanger and the other side end portion, and this opening portion is utilized as a connection space of tubes.

CITATION LIST

Patent Literature

Patent Literature 1: Japanese Examined Utility Model Publication No. 60-18767

SUMMARY OF INVENTION

Technical Problem

In the outdoor unit of the air conditioning device as described above, not only the heat exchanger but also other devices forming a refrigerant circuit such as a compressor, a four way valve, and an accumulator are accommodated. It is thought that tasks such as maintenance and replacement of these devices are performed via the above opening portion.

However, ends of heat transfer tubes bent in a U shape protrude in the one side end portion of the heat exchanger positioned in a peripheral edge of the opening portion. Thus, there is a possibility that a tool to be used for the maintenance and the devices and the like to be replaced are brought into contact with the ends of the heat transfer tubes, and there is a fear that the heat transfer tubes are damaged by this contact.

In particular, in a case where the heat exchanger is provided over a wider range with respect to the four side surfaces of the outdoor unit main body, the opening portion is formed in a minimum necessary range. Therefore, the contact of the tool, the devices, and the like with the heat transfer tubes becomes more problematic.

The present invention is achieved in consideration with the situation described above, and an object thereof is to provide an outdoor unit of an air conditioning device capable of preventing damage to a heat transfer tube of a heat exchanger at the time of performing maintenance, replacement, and the like of devices in an outdoor unit main body via an opening portion.

Solution to Problem

An outdoor unit of an air conditioning device includes an outdoor unit main body having a square planar shape, a heat exchanger provided along a side surface of the outdoor unit main body, and a fan provided in an upper part of the outdoor unit main body, the fan for blowing out air in the outdoor unit main body upward. In the outdoor unit of an air conditioning device, an opening portion capable of providing communication between an interior and an exterior of the outdoor unit main body is formed between a one side end portion and an other side end portion of the heat exchanger adjacent to each other, and in at least one of the side end portions positioned in a peripheral edge of the opening portion, a cover member for covering a heat transfer tube protruding from the side end portion is provided.

With the above configuration, in the side end portion of the heat exchanger positioned in the peripheral edge of the opening portion, the cover member for covering the heat transfer tube protruding from the side end portion is provided. Thus, at the time of performing maintenance, replacement, and the like of devices accommodated in the outdoor unit main body via the opening portion, contact of a tool, the devices, and the like with the heat transfer tube can be prevented, so that the heat transfer tube is not damaged.

The heat transfer tube covered by the cover member can be a U shape tube protruding from the side end portion of the heat exchanger.

The cover member may be provided over the entire heat exchanger in the up and down direction.

With such a configuration, damage to the heat transfer tube can be prevented in the entire heat exchanger in the up and down direction.

The cover member may be a structural member of the outdoor unit main body.

With the above configuration, the cover member is utilized as the structural member of the outdoor unit main body, so that strength of the outdoor unit main body can be enhanced.

The cover member may be a support member of a part attached in the outdoor unit main body.

With the above configuration, there is no need for providing an exclusive support member for a bottom plate, support pillars, and the like of the outdoor unit main body in order to attach the part, so that a structure of the outdoor unit main body can be simplified.

The part may be an optional part.

With the above configuration, by supporting the optional part attached in accordance with an installment environment, user selection, or the like by the cover member, a need for newly providing an exclusive support member for supporting the optional part can be reduced, so that a cost increase following provision of the optional part can be suppressed.

The part may be an electric part.

With the above configuration, even when condensation is generated in the heat transfer tube protruding from the side end portion of the heat exchanger, condensation water can be prevented from being attached to the electric part by the cover member.

An electric component unit may be provided in the upper part of the outdoor unit main body and out of a flow passage of an air flow generated by the fan.

With the above configuration, the air flow in the outdoor unit main body is not prevented by the electric component unit, and a circulation area of the air is sufficiently ensured, so that heat exchange efficiency can be enhanced.

The electric component unit may be supported by the cover member from the lower side.

With such a configuration, the cover member can also be utilized as a support member for supporting the electric component unit, so that a support structure of the electric component unit can be simplified.

The heat exchanger may be provided along four side surfaces of the outdoor unit main body.

With such a configuration, the heat exchanger can be provided over a wider range of the outdoor unit main body, so that the heat exchange efficiency can be enhanced. On the other hand, there is a possibility that width of the opening portion is decreased. However, since the cover member for covering the heat exchange tube is provided in the side end portion of the heat exchanger, at the time of performing the maintenance, the replacement, and the like of the devices in the outdoor unit main body via the opening portion, contact of the tool, the devices, and the like with the heat transfer tube can be favorably prevented.

Advantageous Effects of Invention

According to the present invention, at the time of performing maintenance, replacement, and the like of devices in an outdoor unit main body via an opening portion, damage to a heat transfer tube of a heat exchanger can be prevented.

DESCRIPTION OF EMBODIMENTS

Figure 1:
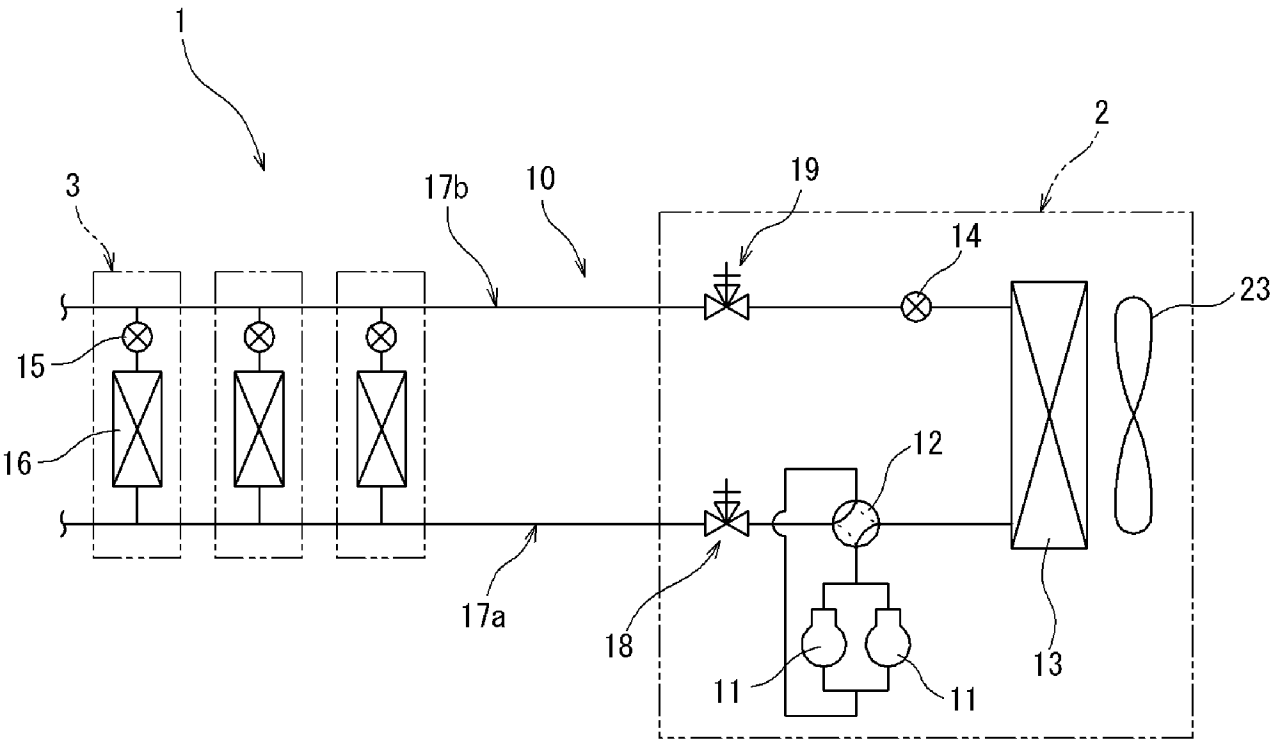
FIG. 1 is a schematic view showing a refrigerant circuit of an air conditioning device having an outdoor unit according to a first embodiment of the present invention.

FIG. 1 is a schematic view showing a refrigerant circuit of an air conditioning device 1 having an outdoor unit 2 according to a first embodiment of the present invention. The air conditioning device 1 is for example a multiple type air conditioning device for a building in which a refrigerant circuit 10 is formed in such a manner that a plurality of indoor units 3 is connected in parallel to one or a plurality of outdoor unit 2 so as to circulate a refrigerant.

In the outdoor unit 2, compressors 11, a four way valve 12, an outdoor heat exchanger 13, an outdoor expansion valve 14, fans 23, and the like are provided. In the indoor unit 3, an indoor expansion valve 15, an indoor heat exchanger 16, and the like are provided. The four way valve 12 and the indoor heat exchanger 16 are connected by a gas side refrigerant communication tube 17*a*, and the outdoor expansion valve 14 and the indoor expansion valve 15 are connected by a liquid side refrigerant communication tube 17*b*. A gas side stop valve 18 and a liquid side stop valve 19 are provided in terminal portions of the inside refrigerant circuit of the outdoor unit 2. The gas side stop valve 18 is arranged on the side of the four way valve 12, and the liquid side stop valve 19 is arranged on the side of the outdoor expansion valve 14. The gas side refrigerant communication tube 17*a* is connected to the gas side stop valve 18, and the liquid side refrigerant communication tube 17*b* is connected to the liquid side stop valve 19.

In the outdoor unit 2 of the present embodiment, the two compressors 11 are provided in parallel. The two compressors 11 may be combination of a variable-capacity inverter compressor for performing speed control by an inverter and a constant-capacity compressor of constant capacity for performing on-off control, or may be combination of two inverter compressors having the same capacity or different capacities or combination of two constant-capacity compressors.

In a case where a cooling operation is performed in the air conditioning device 1 with the above configuration, the four way valve 12 is retained in a state shown by solid lines in FIG. 1. A high-temperature and high-pressure gas refrigerant discharged from the compressors 11 flows into the outdoor heat exchanger 13 via the four way valve 12, and performs heat exchange with the outdoor air by actuation of the fans 23 so as to be condensed and liquefied. The liquefied refrigerant passes through the outdoor expansion valve 14 in a fully open state, and flows into the indoor units 3 through the liquid side refrigerant communication tube 17*b*. In the indoor unit 3, pressure of the refrigerant is reduced to predetermined low pressure by the indoor expansion valve 15, and the refrigerant performs the heat exchange with the indoor air in the indoor heat exchanger 16 so as to be evaporated. The indoor air cooled by evaporation of the refrigerant is blown out to an interior by an indoor fan (not shown) so as to cool the interior. The refrigerant evaporated and gasified in the indoor heat exchanger 16 is returned to the outdoor unit 2 through the gas side refrigerant communication tube 17*a*, and suctioned into the compressors 11.

Meanwhile, in a case where a heating operation is performed, the four way valve 12 is retained in a state shown by broken lines in FIG. 1. A high-temperature and high-pressure gas refrigerant discharged from the compressors 11 flows into the indoor heat exchanger 16 of the indoor unit 3 via the four way valve 12, and performs the heat exchange with the indoor air so as to be condensed and liquefied. The indoor air heated by condensation of the refrigerant is blown out to the interior by the indoor fan so as to heat the interior. The refrigerant liquefied in the indoor heat exchanger 16 is returned to the outdoor unit 2 from the indoor expansion valve 15 in a fully open state through the liquid side refrigerant communication tube 17*b*. The pressure of the refrigerant returned to the outdoor unit 2 is reduced to predetermined low pressure by the outdoor expansion valve 14, and further, the refrigerant performs the heat exchange with the outdoor air in the outdoor heat exchanger 13 so as to be evaporated. The refrigerant evaporated and gasified in the outdoor heat exchanger 13 is suctioned into the compressors 11 via the four way valve 12.

Figure 2:
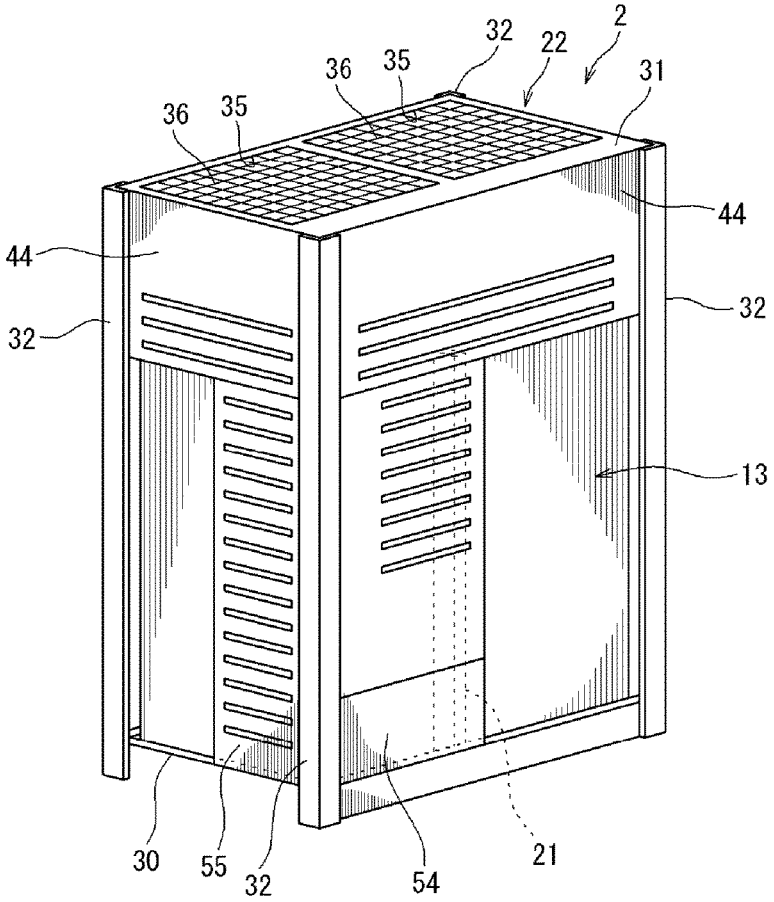
FIG. 2 is a perspective view of the outdoor unit.
Figure 3:
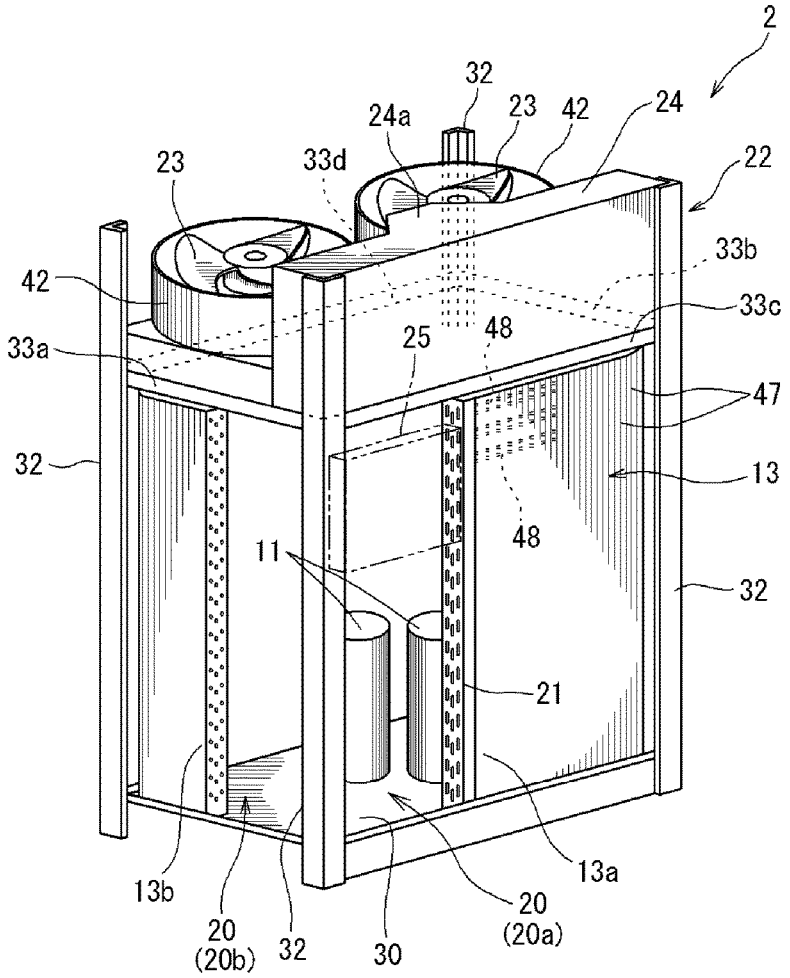
FIG. 3 is a perspective view showing a state that a top plate and side plates of the outdoor unit are removed.
Figure 4:
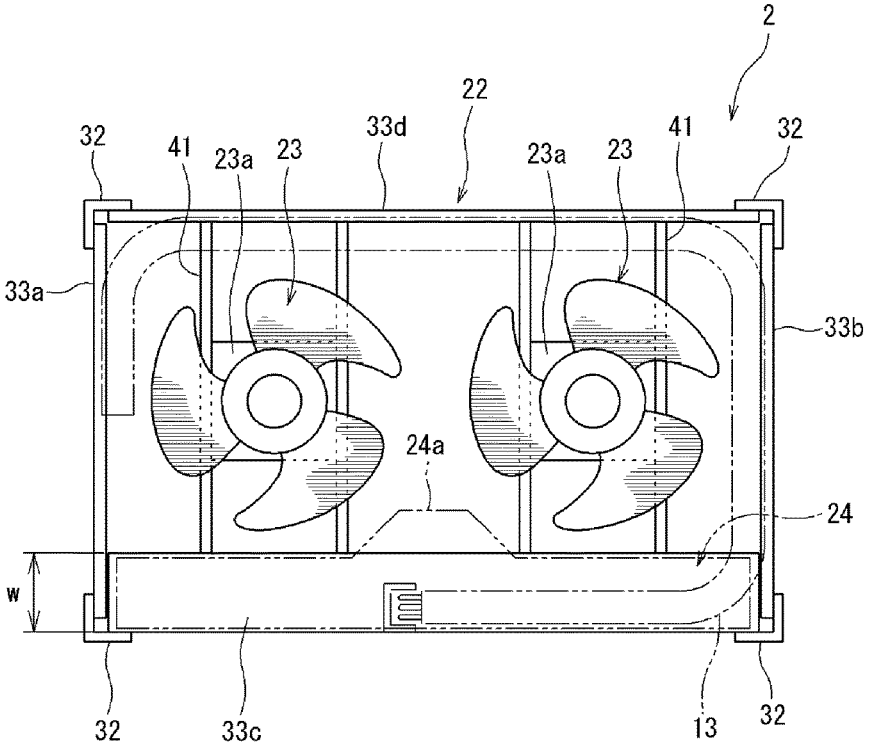
FIG. 4 is an illustrative plan view showing the upper part side inside the outdoor unit.

FIG. 2 is a perspective view of the outdoor unit, FIG. 3 is a perspective view showing a state that a top plate and side plates of the outdoor unit are removed, and FIG. 4 is an illustrative plan view showing the upper part side inside the outdoor unit.

The outdoor unit 2 has an outdoor unit main body 22, and the outdoor heat exchanger 13 arranged along side surfaces of this outdoor unit main body 22. The outdoor unit main body 22 is formed in a substantially cubic shape, and has a bottom plate 30, a top plate 31, support pillars 32, lateral beam members 33*a* to 33*d*, side plates 44, 54, 55, and the like.

As shown in FIGS. 2 to 4, the bottom plate 30 is formed in a square shape in a plan view and in particular, a rectangle shape elongated in the left and right direction. Lower parts of the support pillars 32 are respectively coupled to four corners of the bottom plate 30 by coupling tools such as bolts. The support pillar 32 is formed by for example a substantially L shape angle bar to be fitted to a shape of the corner part of the bottom plate 30.

As shown in FIG. 2, the top plate 31 is formed in a square shape in a plan view which is the substantially same as the bottom plate 30, and arranged so as to have a interval on the upper side of the bottom plate 30. Upper ends of the support pillars 32 are coupled to four corners of the top plate 31 by coupling tools such as bolts. Two square ventilating holes 35 are formed side by side in the left and right direction in the top plate 31, and net bodies 36 for preventing invasion of foreign substances are provided in the ventilating holes 35.

As shown in FIG. 3, the lateral beam members 33*a* to 33*d* are arranged on the upper part side of the support pillars 32 at positions having a predetermined interval downward from the top plate 31, and bridged between the support pillars 32 adjacent to each other in the front and rear direction and the left and right direction. A framework of the outdoor unit main body 22 is formed by structural members including the bottom plate 30, the top plate 31, the support pillars 32, and the lateral beam members 33*a* to 33*d*. A cover member 21 to be described later (refer to FIG. 3) also serves as a structural member (strength member) forming the framework of the outdoor unit main body 22.

As shown in FIG. 4, the lateral beam members 33*a*, 33*b* arranged on both the left and right sides of the outdoor unit main body 22, and the lateral beam member 33*d* arranged on the rear part side of the outdoor unit main body 22 are formed by a thin and long member having a rectangular or L shape section. Meanwhile, the lateral beam member (front lateral beam member) 33*c* arranged on the front part side of the outdoor unit main body 22 is formed by a plate material whose width w in the front and rear direction is formed to be slightly wide. An electric component unit 24 is arranged on this front lateral beam member 33*c*. That is, the front lateral beam member 33*c* is used as a support base of the electric component unit 24. The electric component unit 24 accommodates a control board for controlling the entire outdoor unit 2, an inverter board for controlling the compressors, and other electric parts inside a box shape casing. The electric component unit 24 is provided in a wide range occupying all or almost all the width in the left and right direction of the outdoor unit 2.

Two support bases 41 arranged side by side in the left and right direction are bridged between the front lateral beam member 33*c* and the rear lateral beam member 33*d*. Motors 23*a* of the fans 23 are supported on the support bases 41. As shown in FIG. 3, bell mouths 42 surrounding outer circumferences of the fans 23 and forming ventilating routes are attached to the lateral beam members 33*a* to 33*d*. The electric component unit 24 has a protruding portion 24*a* protruding into a dead space between the two left and right fans 23 (between the bell mouths 42) in a center part in the left and right direction thereof. By this protruding portion 24*a*, inside capacity of the electric component unit 24 is increased.

As shown in FIG. 2, the upper part side plates 44 are provided on the four side surfaces of the outdoor unit main body 22 positioned between the lateral beam members 33*a* to 33*d* and the top plate 31. The fans 23, the bell mouths 42, and the electric component unit (refer to FIG. 3) are covered by the upper part side plates 44 and the top plate 31 so as not to be exposed to an exterior. The upper part side plate 44 on a front surface may form a lid member for openably closing a front surface part of the electric component unit 24.

Figure 5:
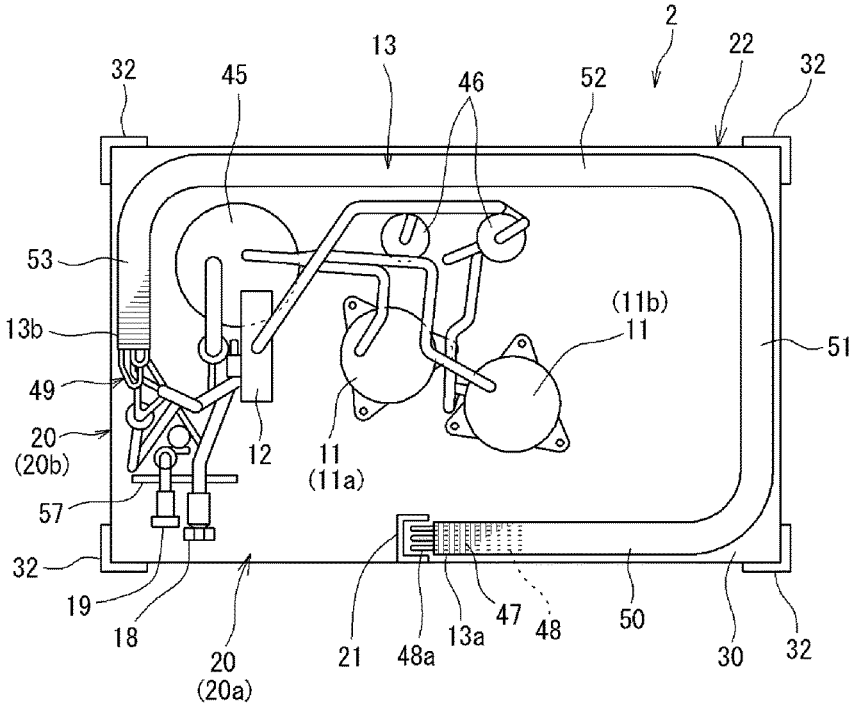
FIG. 5 is an illustrative plan view showing the lower part side inside the outdoor unit.

FIG. 5 is an illustrative plan view showing the lower part side inside the outdoor unit. The devices such as the outdoor heat exchanger 13, the compressors 11, an accumulator 45, and oil separators 46 are mounted on an upper surface of the bottom plate 30 of the outdoor unit main body 22. The outdoor heat exchanger 13 is a fin and tube type heat exchanger of a so-called cross fin type, including a large number of aluminum fins 47 and copper heat transfer tubes 48. The heat transfer tubes 48 form a refrigerant flow passage for circulating the refrigerant while performing the heat exchange with the air, and the plurality of heat transfer tubes is provided in line in the up and down direction. The heat transfer tubes 48 pass through the plurality of fins 47 in an orthogonal manner, and are bent by 180 degrees in a U shape in side end portions on both sides of the outdoor heat exchanger 13 so as to extend in a zigzag manner. Only the U shape bent heat transfer tubes 48 (U shape tubes 48*a*) protrude in a one side end portion 13*a* of the outdoor heat exchanger 13, and ends of the heat transfer tubes 48 connected to a tube group 49 including a capillary tube and a header tube in addition to the U shape bent heat transfer tubes 48 protrude in the other side end portion 13*b*.

The outdoor heat exchanger 13 is bent in a substantially square shape along the four side surfaces of the outdoor unit main body 22. Specifically, the outdoor heat exchanger 13 has a front heat exchange portion 50 along the side surface on the front side of the outdoor unit main body 22 (front surface), a right heat exchange portion 51 along the side surface on the right side, a rear heat exchange portion 52 along the side surface on the rear side (rear surface), and a left heat exchange portion 53 along the side surface on the left side. A part between the front heat exchange portion 50 and the right heat exchange portion 51, a part between the right heat exchange portion 51 and the rear heat exchange portion 52, and a part between the rear heat exchange portion 52 and the left heat exchange portion 53 are bent at 90 degrees or at an angle close to 90 degrees. In the present embodiment, a left end of the front heat exchange portion 50 forms the one side end portion 13*a* of the outdoor heat exchanger 13, and a front end of the left heat exchange portion 53 forms the other side end portion 13*b*.

The front heat exchange portion 50 is provided along a substantially right half range among the front surface of the outdoor unit main body 22. The left heat exchange portion 53 is provided along a substantially rear half range among the left side surface of the outdoor unit main body 22. Therefore, between the one side end portion 13*a* of the outdoor heat exchanger 13 and the other side end portion 13*b*, that is, in a left half of the front surface of the outdoor unit main body 22 and a front half of the left side surface, an opening portion 20 where the outdoor heat exchanger 13 does not exist is formed. It should be noted that the U shape tubes 48*a* provided in the one side end portion 13*a* of the outdoor heat exchanger 13 protrude sideways (leftward) toward an opening portion 20*a* positioned on the front surface of the outdoor unit main body 22.

As shown in FIGS. 2 and 3, the opening portion 20 is divided into two by the support pillar 32. The opening portion 20*a* on the front surface of the outdoor unit main body 22 is closed by the front side plate 54, and an opening portion 20*b* on the left side surface of the outdoor unit main body 22 is closed by the left side plate 55. By removing the front side plate 54 and the left side plate 55, the opening portions 20*a*, 20*b* are opened, so that an interior and an exterior of the outdoor unit main body 22 can communicate with each other. It should be noted that in FIG. 2, a side surface part of the outdoor unit main body 22 other than the upper part side plates 44, the front side plate 54, and the left side plate 55 is not provided with a side plate and the outdoor heat exchanger 13 is exposed as it is. However, a side plate in which a ventilating hole for allowing circulation of the air is formed, or a grid shape member in which a plurality of wire rods is assembled in a grid shape may be provided in the side surface part of the outdoor unit main body 22 facing the outdoor heat exchanger 13.

As shown in FIG. 5, the stop valves 18, 19 are supported via a bracket 57 so as to face the opening portion 20*a* on the front surface of the outdoor unit main body 22. The tube group 49 is arranged in the vicinity of the opening portion 20*b* on the left side surface. The compressor 11*a* arranged on the left side among the two compressors 11 is arranged at such a position that the substantially entire compressor can be visually recognized from the front side via the opening portion 20*a* on the front surface. The compressor 11*b* arranged on the right side is arranged at such a position that the compressor comes in to the slightly right side of the opening portion 20*a*. The accumulator 45 and the oil separators 46 are arranged on the rear part side in the outdoor unit main body 22.

The devices such as the compressors 11 and the valves arranged inside the outdoor unit main body 22 are subjected to regular inspection and maintenance, and these tasks can be performed via the opening portion 20. A replacement task of the devices arranged in the outdoor unit main body 22 can also be performed via the opening portion 20. At the time of performing these tasks, when a tool to be used for the maintenance or the like and the devices and the like to be replaced are brought into contact with the U shape tubes 48*a* protruding from the side end portion 13*a* of the outdoor heat exchanger 13, there is a fear that the U shape tubes 48*a* are damaged. Thus, the cover member 21 for covering the U shape tubes 48*a* is provided in the outdoor unit 2 of the present embodiment, and the U shape tubes 48*a* are protected by this cover member 21.

Figure 6:
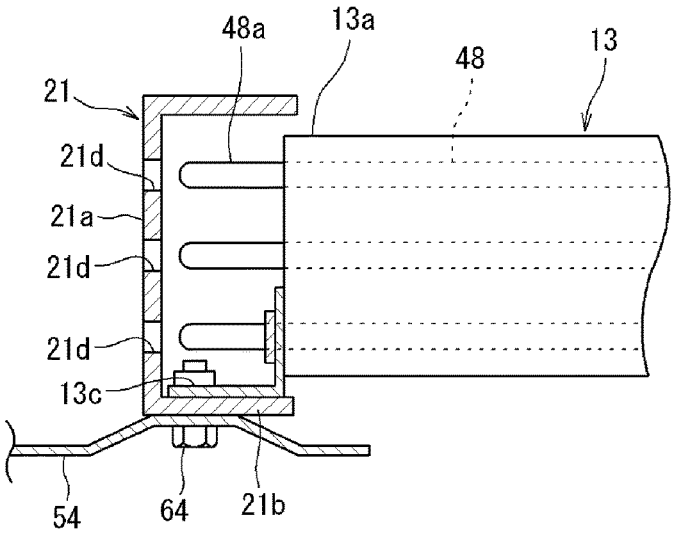
FIG. 6 is a cross sectional view of a cover member.
Figure 7:
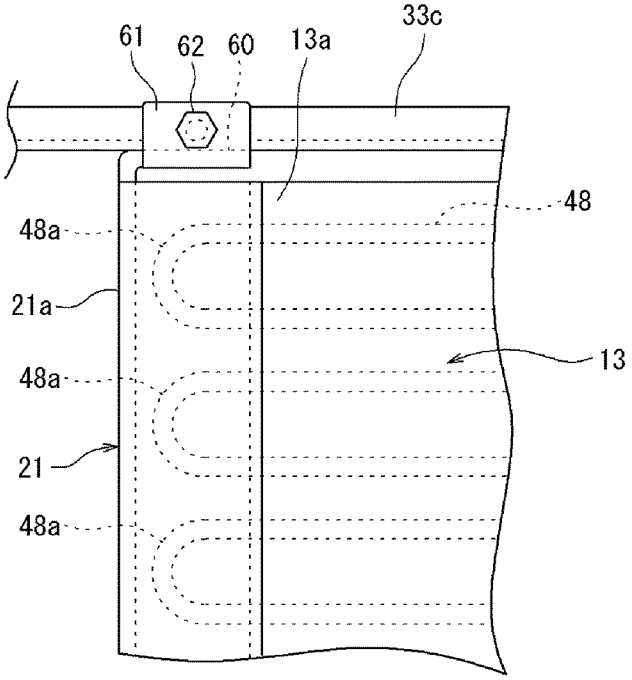
FIG. 7 is a front view showing an upper part of the cover member.
Figure 8:
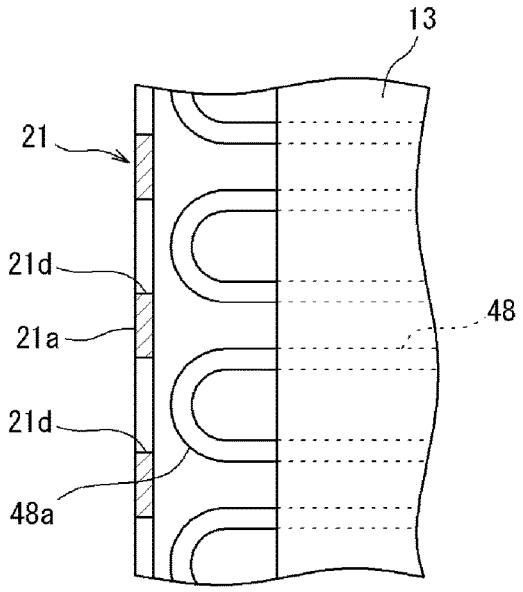
FIG. 8 is a vertically sectional view of the cover member.

FIG. 6 is a cross sectional view of the cover member, FIG. 7 is a front view showing an upper part of the cover member, and FIG. 8 is a vertically sectional view of the cover member. The cover member 21 is formed to have a U shape section in order to cover the U shape tubes 48*a* from three sides of the front, rear, and left sides. The cover member 21 is formed to have an up-down length ranging over the entire height of the outdoor heat exchanger 13, and a lower end thereof is fixed to the bottom plate 30 and an upper end is fixed to the front lateral beam member 33*c*.

Specifically, as shown in FIG. 7, in a side surface plate 21*a* of the cover member 21, an L shape support piece 60 protruding upward is abutted with a lower surface of the front lateral beam member 33*c*. An attachment piece 61 is bent upward in a front end of the support piece 60, and this attachment piece 61 is coupled to a front edge of the front lateral beam member 33*c* by a coupling bolt 62. Therefore, the cover member 21 supports the front lateral beam member 33*c*, and thereby functions as a support member for supporting the electric component unit 24 shown in FIG. 3 from the lower side.

As shown in FIG. 6, a front surface plate 21*b* of the cover member 21 is coupled to a tube plate 13*c* of the outdoor heat exchanger 13 by an attachment bolt 64. The attachment bolt 64 is also used for installing the front side plate 54.

Long holes 21*d* elongated in the up and down direction are formed in the side surface plate 21*a* of the cover member 21. The long holes 21*d* are formed at positions corresponding to the U shape tubes 48*a* of the heat transfer tubes 48. The long holes 21*d* are formed for releasing heat emitted from the heat transfer tubes 48 to the exterior.

In the outdoor unit 2 of the present embodiment described above, the cover member 21 for covering the U shape tubes 48*a* protruding from the one side end portion 13*a* of the outdoor heat exchanger 13 is provided. Thus, in a case where the maintenance, the replacement, and the like of the devices in the outdoor unit main body 22 are performed via the opening portion 20, the U shape tubes 48*a* are not damaged.

Since the cover member 21 is provided in a range over the entire outdoor heat exchanger 13 in the up and down direction, all the U shape tubes 48*a* protruding from the side end portion 13*a* of the outdoor heat exchanger 13 can be protected. In the cover member 21, the upper end is coupled to the front lateral beam member 33*c* and the lower end is coupled to the bottom plate 30. The cover member also functions as a structural member (strength member) of the outdoor unit main body 22 together with these members. Therefore, strength of the outdoor unit main body 22 can be more enhanced.

Since the cover member 21 is coupled to the lower surface of the front lateral beam member 33*c* and supports the front lateral beam member 33*c*, warp of the front lateral beam member 33*c* can be suppressed. In particular, since the cover member 21 is arranged in a substantially center part of the front lateral beam member 33*c* in the left and right direction, the warp of the front lateral beam member 33*c* can be more reliably suppressed. Since the cover member 21 also supports the electric component unit 24 mounted on the front lateral beam member 33*c* from the lower side, the electric component unit 24 can be stably installed.

The electric component unit 24 is arranged in an upper part of the outdoor unit main body 22 and arranged adjacently to the bell mouths 42 forming a flow passage of the air. That is, the electric component unit 24 is arranged out of a flow passage of an air flow generated in the outdoor unit main body 22. Therefore, the electric component unit 24 does not inhibit the air flow in the outdoor unit main body 22, and a circulation area of the air in the outdoor unit main body 22 is sufficiently ensured, so that heat exchange efficiency by the outdoor heat exchanger 13 can be enhanced. Since the electric component unit 24 is arranged in the upper part of the outdoor unit main body 22, the electric component unit can be provided in a wide range in the left and right direction, so that an internal space of the casing of the electric component unit 24 can be widely ensured.

In the outdoor unit 2 of the air conditioning device 1, not only parts and devices normally installed but also an optional part installed in accordance with an installment environment, user selection, or the like is provided. For example, a transformer, a noise filter, and the like required in a case where the outdoor unit 2 is used overseas correspond to the optional part. When such the optional part is provided in the outdoor unit main body 22, in general, there is a need for providing an exclusive support bracket or the like in the bottom plate 30, the support pillar, or the like. However, in the present embodiment, the above cover member 21 can be utilized as a support member of the optional part.

Specifically, by forming an attachment hole (female screw hole) for preliminarily attaching the optional part to the cover member 21 or forming a locking hole (locking groove) or the like for suspending the optional part, the optional part 25 can be supported by the cover member 21 as shown in FIG. 3. The optional part 25 may be supported together with the support pillar 32 adjacent to the cover member 21. By supporting the optional part 25 by the cover member 21 in such a way, a new support member added in accordance with installment of the optional part 25 can be eliminated or reduced. Thus, a cost increase following the installment of the optional part 25 can be suppressed.

It should be noted that the cover member 21 has a function of preventing condensation or the like generated in the U shape tubes 48*a* from being attached to the optional part 25. Therefore, particularly in a case where the optional part 25 is an electric part such as a transformer, a disadvantage following attachment of water content can be favorably solved. The cover member 21 also has a function of preventing contact of the optional part 25 with the U shape tubes 48*a* at the time of installing the optional part 25.

Figure 9:
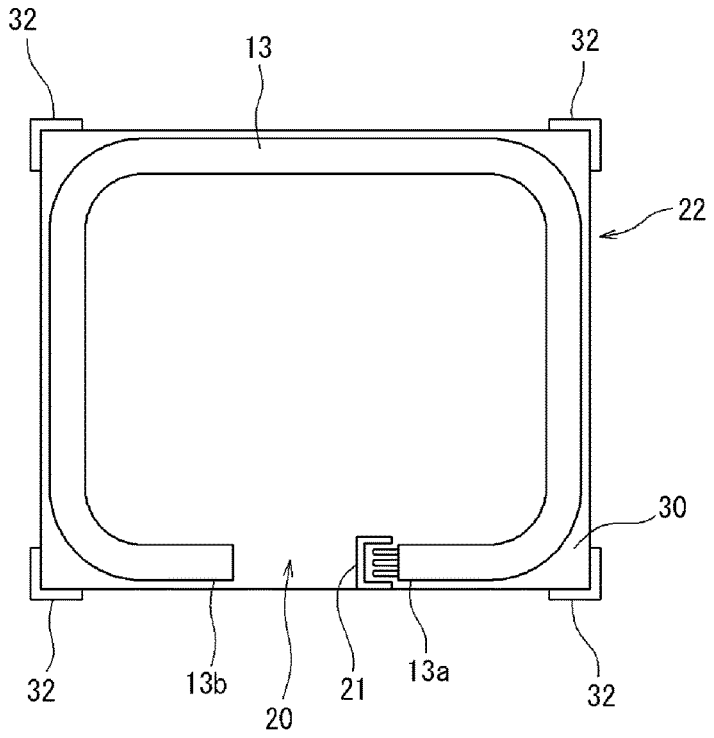
FIG. 9 is an illustrative plan view schematically showing arrangement of a heat exchanger in an outdoor unit of an air conditioning device according to a second embodiment of the present invention.
Figure 10:
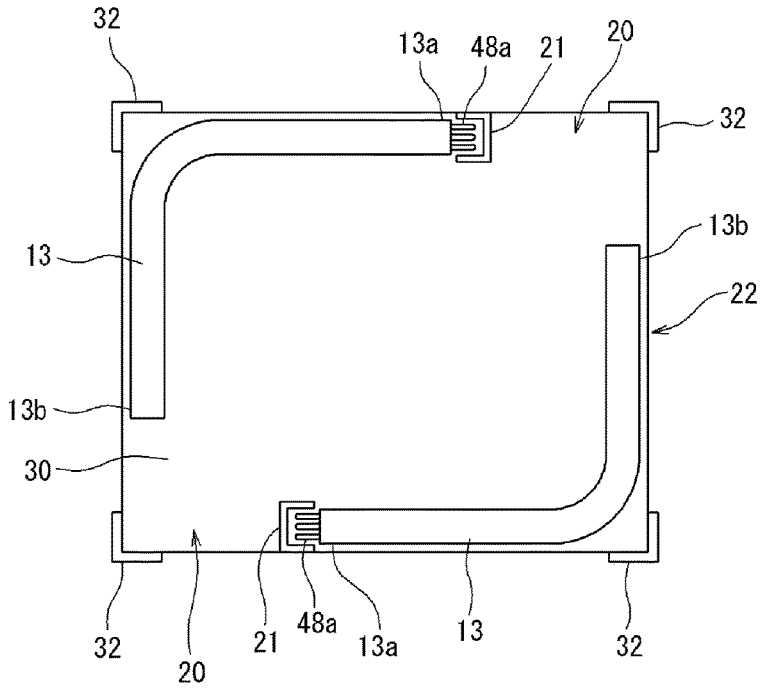
FIG. 10 is an illustrative plan view schematically showing arrangement of a heat exchanger in an outdoor unit of an air conditioning device according to a third embodiment of the present invention.
Figure 11:
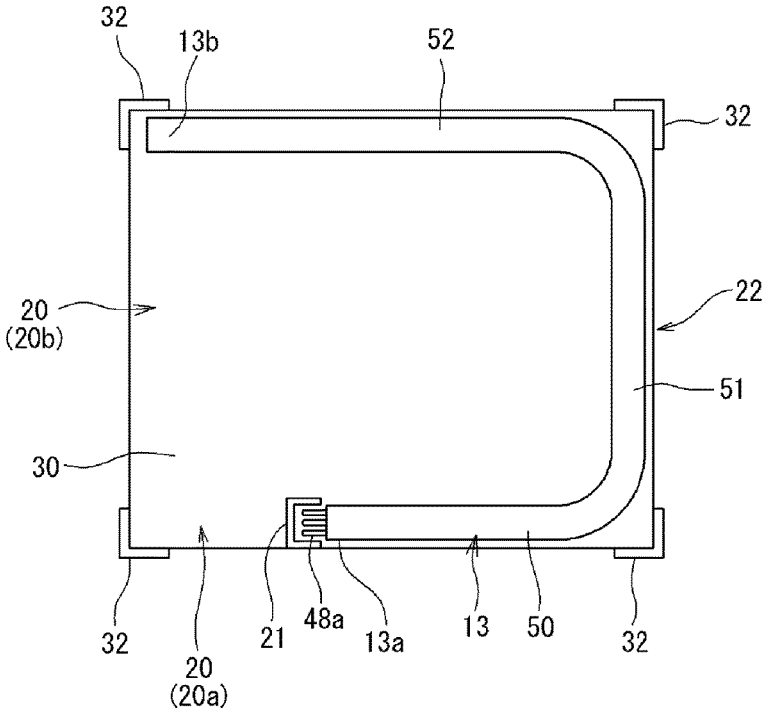
FIG. 11 is an illustrative plan view schematically showing arrangement of a heat exchanger in an outdoor unit of an air conditioning device according to a fourth embodiment of the present invention.

The above outdoor heat exchanger 13 can also be arranged for example as shown in FIGS. 9 to 11.

FIG. 9 is an illustrative plan view schematically showing arrangement of a heat exchanger in an outdoor unit of an air conditioning device according to a second embodiment of the present invention. The outdoor heat exchanger 13 shown in FIG. 9 is bent at an angle of about 90 degrees at four points placed away in the longitudinal direction. On one side surface (front surface) of the outdoor unit main body 22, the one side end portion 13*a* and the other side end portion 13*b* are adjacent to each other, and the opening portion 20 is formed between both the side end portions 13*a*, 13*b*. The U shape tubes 48*a* protruding from the one side end portion 13*a* of the outdoor heat exchanger 13 are covered by the cover member 21.

FIG. 10 is an illustrative plan view schematically showing arrangement of a heat exchanger in an outdoor unit of an air conditioning device according to a third embodiment of the present invention. In the outdoor unit 2 shown in FIG. 10, two outdoor heat exchangers 13 are provided, and the outdoor heat exchangers 13 are bent in an L shape. One of the outdoor heat exchangers 13 is arranged along the front surface and the right side surface of the outdoor unit main body 22, and the other outdoor heat exchanger 13 is arranged along the rear surface and the left side surface of the outdoor unit main body 22. The opening portion 20 is formed between the side end portion 13*a* of one of the outdoor heat exchangers 13 and the side end portion 13*b* of the other outdoor heat exchanger 13. That is, the opening portion 20 is formed in each of two corner parts positioned on a diagonal line of the outdoor unit main body 22. The cover member 21 for covering the U shape tubes 48*a* is provided in the side end portion 13*a* of the outdoor heat exchanger 13 positioned in a peripheral edge of each of the opening portions 20.

It should be noted that in the example shown in FIG. 10, by extending the one side end portion 13*a* in one of the outdoor heat exchangers 13 and the other side end portion 13*b* in the other outdoor heat exchanger 13 adjacent to this in the direction in which the side end portions come close to each other, one of the opening portions 20 can be omitted.

In the example shown in FIG. 10, the side end portion 13*a* from which only the U shape tubes 48*a* protrude in one of the outdoor heat exchangers 13 and the side end portion 13*a* from which only the U shape tubes 48*a* protrude in the other outdoor heat exchanger 13 may be placed adjacently to each other, and the opening portion 20 may be formed between both the side end portions 13*a*, 13*a*. In this case, the cover members 21 may be provided for both the side end portions 13*a*, 13*a*.

FIG. 11 is an illustrative plan view schematically showing arrangement of a heat exchanger in an outdoor unit of an air conditioning device according to a fourth embodiment of the present invention. The outdoor heat exchanger 13 shown in FIG. 11 is arranged along the front surface, the right side surface, and the rear surface of the outdoor unit main body 22 but not arranged on the left side surface. That is, the outdoor heat exchanger 13 includes the front heat exchange portion 50, the right heat exchange portion 51, and the rear heat exchange portion 52, and is arranged along the three side surfaces of the outdoor unit main body 22. The opening portion 20*a* is provided on the front surface of the outdoor unit main body 22 in a range on the left side of the side end portion 13*a* of the front heat exchange portion 50. The opening portion 20*b* is also provided on the left side surface of the outdoor unit main body 22, and the opening portion 20 is divided into two by the support pillar 32 on the left front side. The U shape tubes 48*a* protruding sideways toward the side of the opening portion 20*a* are provided in the side end portion 13*a* of the front heat exchange portion 50, and the U shape tubes 48*a* are covered by the cover member 21. Therefore, at the time of performing the maintenance, the replacement, and the like of the devices in the outdoor unit main body 22 via the opening portion 20*a* on the front surface of the outdoor unit main body 22, contact of the devices with the U shape tubes 48*a* and damage to the U shape tubes 48*a* can be prevented.

The present invention is not limited to the above embodiments but can be appropriately changed within the scope of the invention described in the claims.

For example, the cover member 21 may be provided for covering not only the U shape tubes 48*a* in the one side end portion 13*a* of the outdoor heat exchanger 13 but also U shape tubes or the ends of the heat transfer tubes in the other side end portion 13*b*. That is, the cover members 21 may be provided for both the side end portions 13*a*, 13*b* of the outdoor heat exchanger 13 positioned in the peripheral edge of the opening portion 20.

The opening portion 20 may be provided on any side surface of the outdoor unit main body 22.

Although the electric component unit 24 is provided in the upper part of the outdoor unit main body 22, the electric component unit 24 may be attached to the cover member 21 and the support pillar 32 adjacent to this as well as the above optional part 25.

Although the two compressors 11 are provided in the outdoor unit 2 in the above embodiments, one or three or more compressors 11 may be provided. Arrangement and the like of the compressors 11 and other devices can be appropriately changed. Although the outdoor heat exchanger 13 is provided along the four or three side surfaces of the outdoor unit main body 22 in the above embodiments, the outdoor heat exchanger 13 is only required to be provided along two or more plural side surfaces.

REFERENCE SIGNS LIST

1: Air conditioning device
2: Outdoor unit

13: Outdoor heat exchanger
20: Opening portion
21: Cover member
22: Outdoor unit main body
23: Fan
24: Electric component unit
25: Optional part

The invention claimed is:

1. An outdoor unit of an air conditioning device comprising: an outdoor unit main body having a rectangular planar shape and including a top plate and a bottom plate and a plurality of side plates each forming at least part of a corresponding side surface of the main body;

a heat exchanger provided along the side surface of the outdoor unit main body;

a compressor arranged on an interior side of the outdoor unit main body in the state of being surrounded by the heat exchanger; and a fan provided in an upper part of the outdoor unit main body, the fan for blowing out air in the outdoor unit main body upward, wherein at least one of the side plates of the main body is capable of being displaced to form an opening portion providing external access to an interior of the outdoor unit main body for taking in and out the compressor between the interior side of the outdoor unit main body and an exterior side of the outdoor unit main body, the opening portion being formed between a first side end portion and a second side end portion of the heat exchanger which are adjacent to each other, a cover member is provided covering portions of a heat transfer tube protruding from the first side end portion at a peripheral edge of the opening portion, the cover member blocking exposure of the protruding portions to the opening portion thus preventing damage to the protruding portions of the heat transfer tube at a time of taking in and out the compressor between the interior side and the exterior side of the outdoor unit main body via the opening portion, the cover member includes a U-shape section ranging over substantially the height of the heat exchanger so as to cover all protruding portions of the heat transfer tube, the cover member being integrally formed, the U-shape section being a plate bent only into three substantially planar sections respectively covering three sides of the protruding portions of the heat transfer tube, the three sides including:

two sides which are adjacent to a side of the first side end portion from which the protruding portion protrudes; and one side which is opposite the side of the first side end portion from which the protruding portion protrudes, the U-shape section is configured so that the protruding portion is disposed between the cover member and the side of the first side end portion, and the at least one of the side plates of the main body is coupled to the cover member removably.

2. The outdoor unit of the air conditioning device according to claim 1, wherein each of the portions of the heat transfer tube covered by the cover member is a U shape tube protruding from the first side end portion of the heat exchanger.

3. The outdoor unit of the air conditioning device according to claim 1, wherein the cover member is provided over the entire heat exchanger in the up and down direction.

4. The outdoor unit of the air conditioning device according to claim 1, wherein the cover member is constituted as a structural member of the outdoor unit main body.

5. The outdoor unit of the air conditioning device according to claim 1, wherein the cover member is constituted as a support member of a part attached in the outdoor unit main body.

6. The outdoor unit of the air conditioning device according to claim 5, wherein the part, of which the cover member is a support member, is an optional part.

7. The outdoor unit of the air conditioning device according to claim 5, wherein the part, of which the cover member is a support member, is an electric part.

8. The outdoor unit of the air conditioning device according to claim 1, wherein an electric component unit is provided in the upper part of the outdoor unit main body and out of a flow passage of an air flow generated by the fan.

9. The outdoor unit of the air conditioning device according to claim 8, wherein the electric component unit is supported by the cover member from the lower side.

10. The outdoor unit of the air conditioning device according to claim 1, wherein the heat exchanger is provided along four side surfaces of the outdoor unit main body.

11. The outdoor unit of the air conditioning device according to claim 2, wherein the cover member is provided over the entire heat exchanger in the up and down direction.

12. The outdoor unit of the air conditioning device according to claim 2, wherein the cover member is constituted as a structural member of the outdoor unit main body.

13. The outdoor unit of the air conditioning device according to claim 3, wherein the cover member is constituted as a structural member of the outdoor unit main body.

14. The outdoor unit of the air conditioning device according to claim 2, wherein the cover member is constituted as a support member of a part attached in the outdoor unit main body.

15. The outdoor unit of the air conditioning device according to claim 3, wherein the cover member is constituted as a support member of a part attached in the outdoor unit main body.

16. The outdoor unit of the air conditioning device according to claim 4, wherein the cover member is constituted as a support member of a part attached in the outdoor unit main body.

17. The outdoor unit of the air conditioning device according to claim 6, wherein the part, of which the cover member is a support member, is an electric part.

18. The outdoor unit of the air conditioning device according to claim 2, wherein an electric component unit is provided in the upper part of the outdoor unit main body and out of a flow passage of an air flow generated by the fan.

19. The outdoor unit of the air conditioning device according to claim 3, wherein an electric component unit is provided in the upper part of the outdoor unit main body and out of a flow passage of an air flow generated by the fan.

20. The outdoor unit of the air conditioning device according to claim 4, wherein an electric component unit is provided in the upper part of the outdoor unit main body and out of a flow passage of an air flow generated by the fan.

21. The outdoor unit of the air conditioning device according to claim 1, wherein the at least one side plate is coupled to the cover member by an attachment bolt, the attachment bolt being removable in order to displace the at least one side plate to form the opening portion.

* * * * *